United States Patent [19]

Geekie, Jr.

[11] Patent Number: 4,498,612

[45] Date of Patent: Feb. 12, 1985

[54] CARTRIDGE AND SHOTGUN SHELL CARRYING BUCKLE

[76] Inventor: James A. Geekie, Jr., 443 Merrimac St., Newburyport, Mass. 01950

[21] Appl. No.: 637,350

[22] Filed: Aug. 6, 1984

Related U.S. Application Data

[63] Continuation-in-part of Ser. No. 463,320, Mar. 9, 1983, abandoned.

[51] Int. Cl.[3] ..... A44B 11/22; A45C 11/00

[52] U.S. Cl. ..... 224/163; 24/3 R; 24/163 R; 224/247; 224/918

[58] Field of Search ..... 206/3, 480; 224/163, 224/239, 247, 248, 249, 918; D2/406; 24/3 L, 3 R, 163 R; 446/473

[56] References Cited

U.S. PATENT DOCUMENTS

| | | | |
|---|---|---|---|
| 491,136 | 2/1893 | Rosenblatt et al. | 206/480 |
| 1,061,954 | 5/1913 | Bloch | 224/163 |
| 1,712,686 | 5/1929 | Bornmann | 206/480 |
| 2,592,415 | 4/1952 | Grogan | 224/239 X |
| 3,148,426 | 9/1964 | Lesser et al. | D2/406 X |
| 3,616,976 | 11/1971 | Geretschlaeger | 224/249 |
| 3,702,671 | 11/1972 | Cirillo | 224/249 X |
| 4,377,249 | 3/1983 | Bockoven | 224/163 |
| 4,389,775 | 6/1983 | Collins | 224/163 |

FOREIGN PATENT DOCUMENTS

| | | | |
|---|---|---|---|
| 122960 | 8/1901 | Fed. Rep. of Germany | 224/247 |
| 300428 | 11/1928 | United Kingdom | 224/918 |

*Primary Examiner*—Allan N. Shoap
*Attorney, Agent, or Firm*—John P. McGonagle

[57] ABSTRACT

A belt buckle adapted for use also as a cartridge and shotgun shell holder. The buckle has attached to its front side three parallel rows of spring clips arranged to hold up to three conventional cartridges or shotgun shells horizontally across the buckle. The buckle also has a shield to protect the cartridge and shotgun shell primers. The shield also provides a brace and pivot point for removal of the cartridges. The forward end of the buckle is bent backwards so that a hunter's fingers can easily slip beneath the heads of the cartridges or shotgun shells.

6 Claims, 6 Drawing Figures

CARTRIDGE AND SHOTGUN SHELL CARRYING BUCKLE

CROSS-REFERENCE

This is a continuation-in-part of Ser. No. 06/463,320, filed 03/09/83, now abandoned.

BACKGROUND OF THE INVENTION

This invention relates to belt buckles and in particular to a belt buckle for carrying cartridges or shotgun shells.

When hunting or pursuing big game and other dangerous animals, a reserve supply of ammunition, readily available for rapid reloading of the hunter's firearm, is most desireable and very important for the hunter's safety. Since the larger cartridges and shotgun shells used in hunting big game and other dangerous animals are prone to misfiring if damaged, and since the pursuit of these types of animals is often through rugged terrain, the reserve supply of ammunition must not only be readily available but also must be carried in such a manner that the primers of the cartridges and shells are protected.

Cartridge and shotgun shell holders heretofore have typically used loops around individual cartridges or some type of pouch arrangement which require opening before access is had to the cartridges. In the haste of reloading in the face of a charging big game or other dangerous animal, the loops tend to slow removal of the cartridge. Opening a pouch to gain access to reserve ammunition is too time consuming in this type of situation. Where previously spring clips have been used to hold cartridges or shells, little or no protection has been provided for the cartridges or shells. Damage to the cartridge or shells could occur causing misfires, which in turn seriously jeopardizes the safety of a hunter in the presence of a large and/or dangerous animal.

SUMMARY OF THE INVENTION

This invention relates to a belt buckle, worn on a belt tied around a hunter's waist, which employs spring clips for holding conventional cartridges or shotgun shells. The buckle has a shield which protects the cartridge or shotgun shell primers. The buckle is shaped in such a manner that access to the cartridges or shotgun shells is particularly easy.

Accordingly, it is an object of this invention to provide a cartridge and shotgun shell carrying belt buckle which provides rapid access to the cartridges or shotgun shells while at the same time providing protection for cartridge and shotgun shell primers.

It is another object according to the present invention to provide an improved cartridge and shotgun shell holder which is simple in design, easy to manufacture, and reliable in operation.

Other objects and features of the present invention will become apparent from the following detailed description considered in connection with the accompanying drawings which disclose an embodiment of the invention.

DETAILED DESCRIPTION OF THE INVENTION

Figure 1:
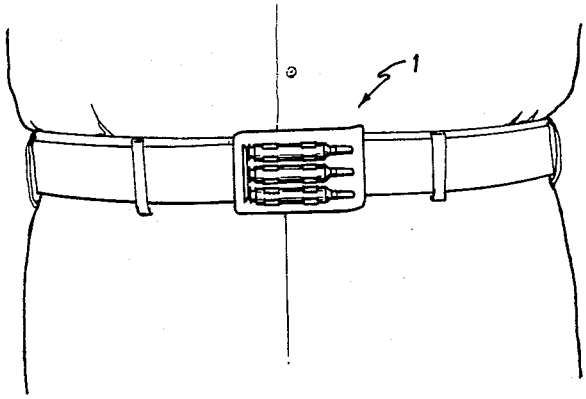
FIG. 1 is a perspective view of one embodiment of the invention with cartridges in place.

Referring more particularly to the drawings reference numeral 1 refers generally to the buckle comprising one embodiment of the present invention.

Figure 2:
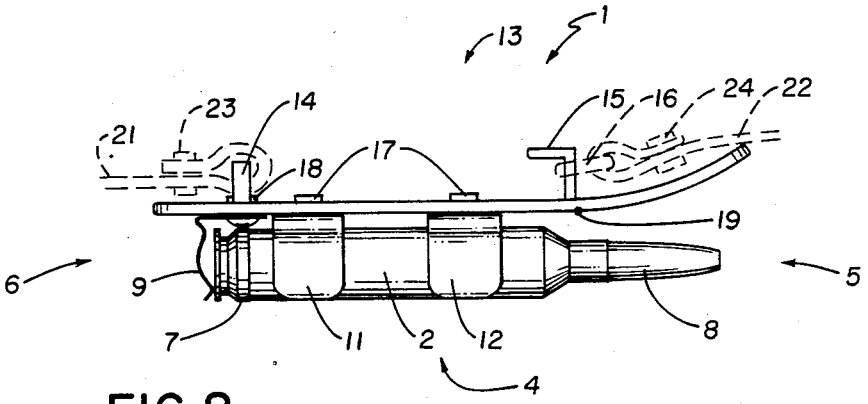
FIG. 2 is a top view of the structure shown in FIG. 1.

FIG. 1 is a perspective view of the buckle 1 as worn by a hunter and is holding three cartridges 2. FIG. 2 is a front view of the buckle shown in FIG. 1. The buckle 1 has its front side 4 showing. It has a rectangular shape 3 with rounded corners. The overall size of the buckle 1 is not critical but it should be at least as large as the cartridges or shell it holds. This embodiment has a length of four inches and a width of two and one-quarter inches. The buckle 1 is generally flat and made of a sturdy material such as aluminum plate, three thirty-seconds of an inch thick. The buckle 1 has a forward end 5, a rearward end 6, a top 10 and a bottom 20. The cartridges 2 are held in place on the front side 4 of the buckle 1 by means of spring steel clips 11 and 12 riveted 17 to the buckle 1. The clips 11 and 12 lie horizontally in three parallel rows of two each; The rearward clips 11 are fastened to the buckle's front side 4 of approximately one-half inch forward of a primer shield 9 which in turn is approximately one-quarter inch from the rearward edge 6 of the buckle 1. The forward clips 12 are fastened to the buckle's front side 4 approximately nine-sixteenths inches forward of the rearward clips 11. The cartridges 2 are positioned on the front 4 of the buckle 1 horizontally from the rearward end 6 to the forward end 5. The primer ends 7 of the cartridges 2 are positioned at the buckle's rearward end 6 and the cartridge heads 8 are positioned toward the buckle forward end 5. A primer shield 9 in a vertical arrangement is positioned near and parallel to the buckle's rearward end 6. The primer shield 9 is shaped like a very wide "L". The upright leg of the "L" is the shield and the horizontal leg of the "L" is riveted 18 to the buckle front 4. The purpose of the primer shield 9 is to protect the cartridge primers 7 and to provide a brace and pivot point for easy removal of the cartridges 2.

FIG. 2 is a top view of the buckle 1. The buckle's forward end 5 is bent at 19 approximately 35° towards the buckle's back side 13 and approximately one and one-eighth inches from the buckle's forward end 5. This allows a hunter's fingers to slip easily under the cartridges heads 8 when removing a cartridge 2. As can be seen from the drawing, the primer shield 9 upright leg is curved. This gives a certain spring action to ease the removal of the cartridges 2. On the buckle's back side 13 there are two protruding vertical elements, a belt attachment loop 14 and a "D" ring hook 15. The belt attachment loop 14 is a "C" shaped piece of sturdy material, such as aluminum, in a rectangular configuration, which is welded to the buckle's back side 13 in a vertical arrangement near and running parallel to the buckle's rearward end 6. It is attached approximately one-half inch from the buckle's rearward end 6. Belt material 21 is fastened 23 about the belt attachment loop 14 and is the means by which the buckle 1 is attached to a belt. Near the buckle's forward end 5 is a rectangular-shaped, rearward bent hook 5 for grasping a "D" ring 16 attached 24 to a belt. The hook 15 is made of a sturdy material such as aluminum and is welded to the buckle back side 13 in a vertical arrangement near and running parallel to the buckle's forward end 5 appoximately five-sixteenths inches rearward of the buckle bend 19. Visible also in this figure are two of the six spring clips 11 and 12 holding a cartridge 2 to the buckle front side 4.

Figure 3:
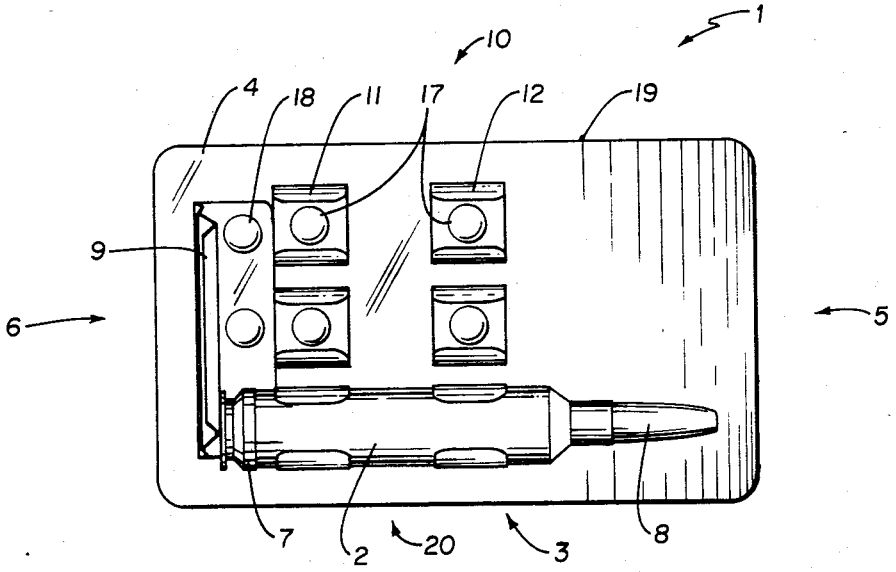
FIG. 3 is a front view of the invention.
Figure 4:
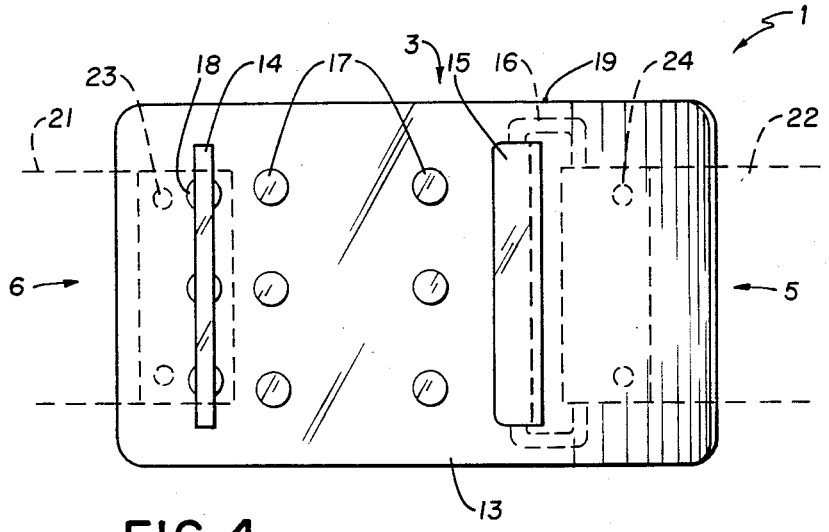
FIG. 4 is a back view of the structure shown in FIG. 3.

FIG. 4 is a back view of the buckle shown in FIG. 3. As can be seen from this view the belt attachment loop 14 is attached to the buckle's back side 13 near the buckle rearward end 6. The loop 14 runs nearly the width of the buckle 1 and is arranged parallel to the buckle rearward end 6. The belt hook 15 is attached to the buckle's back side 13 near the buckle forward end 6. The hook 15 runs nearly the width of the buckle 1 and is arranged parallel to the buckle forward end 5.

Figure 5:
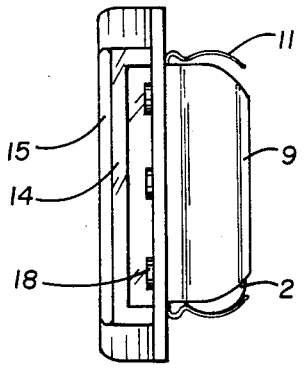
FIG. 5 is a rear view of the structure shown in FIG. 4.

FIG. 5 is a rear view of the buckle shown in FIG. 4. The generally rectangular shape of the primer shield 9 attached to the buckle's front side 4 is apparent. The primer shield 9 has a vertical width approximately equal to the overall width of the three parallel rows of spring clips 11 and 12. Also visible is the generally rectangular shape of the belt attachment "C" loop 14.

Figure 6:
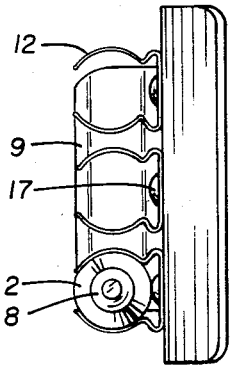
FIG. 6 is a view of the forward end of the structure shown in FIG. 5.

FIG. 6 is a view of the forward end of the buckle shown in FIG. 5. The parallel arrangement of the forward spring clips 12 is apparent as is the backward bend of the buckle's forward end 5. One cartridge 2 is shown in place for perspective.

It is understood that the above-described embodiment is merely illustrative of the application. The buckle may be used either right handed or left handed depending on the user's inclination. It is worn around the waist attached to a leather or other material belt. Other embodiments may be readily devised by those skilled in the art which embody the principles of the invention and fall within the spirit and scope thereof.

I claim:

1. A belt buckle adapted for use as a cartridge and shotgun shell holder, comprising:

a flat buckle with a generally rectangular shape, having a front side, a back side, a top, a bottom, a forward end, and a rearward end, the forward end of which is bent backwards approximately thirty-five degrees;

a pluality of spring clips attached to the buckle front side for holding a plurality of cartridges and shotgun shells having conventional primer ends and heads in a generally horizontal configuration with cartridge and shotgun shell heads positioned at the buckle forward end and cartridge and shotgun shell primer ends positioned at the buckle rearward end;

a shield for protection of the cartridge and shotgun shell primers attached to the buckle front side in a vertical arrangement near and parallel to the buckle's rearward end; and a means for attaching the buckle to a belt.

2. A belt buckle as recited in claim 1 wherein the means for attaching the buckle to a belt comprise:

a belt attachment loop attached to the buckle's back side in a vertical arrangement near and running parallel to the buckle's rearward end; and a rectangular-shaped hook bending rearward and attached to the buckle's back side in a vertical arrangement near and running parallel to the bend in the buckle's forward end.

3. A belt buckle as recited in claim 2 wherein:

the shield forms a generally vertical rectangular protrusion from the front side of the buckle to a height approximately equal to the width of a cartridge or shotgun shell.

4. A belt buckle as recited in claim 3 wherein:

the plurality of spring clips is arranged horizontally in three parallel rows of two each.

5. A belt buckle as recited in claim 4 wherein:

the shield lies between the rearmost spring clips and the rearward end of the buckle.

6. A belt buckle as recited in claim 5 wherein:

the shield has a vertical width approximately equal to the overall width of the three parallel rows of spring clips.

* * * * *